United States Patent [19]

Pietrelli

[11] Patent Number: 4,557,127

[45] Date of Patent: Dec. 10, 1985

[54] MOTOR VEHICLE BODY REPAIR BENCH

[76] Inventor: Giuseppe Pietrelli, Via San Leonardo n. 434, Massa, Italy

[21] Appl. No.: 508,057

[22] Filed: Jun. 24, 1983

[30] Foreign Application Priority Data

Feb. 28, 1983 [IT] Italy ..... 67225 A/83

[51] Int. Cl.[4] ..... B21D 1/14

[52] U.S. Cl. ..... 72/34; 33/180 AT; 72/705

[58] Field of Search ..... 72/482, 705, 34; 33/180 AT, 181 AT, 288; 269/9, 60, 71, 73, 900

[56] References Cited

U.S. PATENT DOCUMENTS

| | | | |
|---|---|---|---|
| 3,046,006 | 7/1962 | Kulicke, Jr. | 269/60 |
| 3,245,678 | 4/1966 | Riehle | 269/900 |
| 4,193,203 | 3/1980 | LeGrand et al. | 33/180 AT |
| 4,344,314 | 8/1982 | Aldrich et al. | 72/705 |
| 4,442,608 | 4/1984 | Clausen | 33/288 |

FOREIGN PATENT DOCUMENTS

| | | | |
|---|---|---|---|
| 2831627 | 2/1979 | Fed. Rep. of Germany | 72/705 |

*Primary Examiner*—Lowell A. Larson
*Attorney, Agent, or Firm*—Paul & Paul

[57] ABSTRACT

A motor vehicle body repair bench comprising a standard support for body repairing jigs, made of a bracket having a horizontal cross-shaped slide supporting a vertically slidable rod provided with an upper member of inverted U-shape. The standard support is mounted on a crossbeam and has three degrees of freedom of movement within its structure so that the upper member of inverted U-shape will reproduce adjacent the motor vehicle body a portion of the crossbeam. The universality of the standard support permits the use of body repairing jigs of reduced dimensions, which are mounted on the member of inverted U-shape, and permits positive repairing operations to be carried out in any position on the motor vehicle body.

3 Claims, 8 Drawing Figures

MOTOR VEHICLE BODY REPAIR BENCH

BACKGROUND OF THE INVENTION

This invention relates to a motor vehicle body repair bench provided with standard supports for body repairing jigs, these supports having three degrees of freedom of movement.

Many types of benches for repairing and/or checking damaged motor vehicle bodies after an accident are known. They generally comprise a pair of parallel longitudinal members to which crossbeams are secured from which depart members known in the art as "jigs" for securing to or checking portions of the motor vehicle body.

A first type of such benches, which is still widespread, comprises jigs that are removably secured to the crossbeam and each have a geometric configuration such as to reach through an appropriate element the portion of the motor vehicle body involved in the repairing operation. With such a bench the repair and/or checking of the motor vehicle body is facilitated and simplified; however, a series of expressly designed jigs is required for each type of motor vehicle.

Numerous attempts have been made to eliminate the use of special jigs for each type of motor vehicle. Thus, repair benches are known which substantially adopt the "metric" or "measurement" system in which a substantially universal fixing and/or checking member translates over the entire longitudinal and transverse extension of the bench and also in the vertical direction so that any point of the motor vehicle body can be reached without resorting to members having a particular spatial configuration (jigs). Such a "metric" system therefore does not require a large stock of jigs, but has the great disadvantage that it does not permit a "positive" repair of the motor vehicle body. The term "positive" is used in the relevant art and the present specification to define a method of repairing by which various points of the motor vehicle body can be simultaneously retained and/or checked completely independently of one another.

Thus, the disadvantage of the repair benches based on the "metric" system consists in that, for example, when two support members are located on a single crossbeam, it necessarily limits the alignment therebetween with the result that it is not possible to check points of the motor vehicle body located asymmetrically on the right or the left of the crossbeam. Although, on the one hand, the jigs are eliminated, on the other hand, no "positive" repair can be carried out as, when the repair operation involves an asymmetric fixing and/or checking, as mentioned above, the fixing of one point has to be abandoned before proceeding to fixing of another point.

The consequences of this method are well known to those skilled in the art and are such as to render dubious the advantages of such systems over the one mentioned above, using fixed jigs specially designed for each motor vehicle.

It is an object of the present invention to eliminate or reduce the disadvantages of the known repair benches by providing a repair bench which does not require the use of jigs formed integrally with the support member and different for each type of motor vehicle and always bulky and expensive, but requires the provision of specific elements of minimum dimensions and cost within a structure which is even more sturdy, accurate and reliable than the conventional ones.

Another object of the present invention is to provide a repair bench which associates certain advantages of the repair benches using the "metric" system, consisting essentially in the possibility of making an estimate of the deformation of the damaged motor vehicle body, with the advantages of a "positive" repair and ease of use of the conventional benches using "jigs".

SUMMARY OF THE INVENTION

These and other objects and advantages of the invention, which will become apparent from the following description, are achieved according to the invention by providing a motor vehicle repair bench having standard jig supports and a structure comprising a pair of parallel longitudinal members to which crossbeams with perforated side and upper surfaces are secured, characterized in that said standard jig supports are removably mounted on said crossbeams, each of said standard jig supports comprising a cross-shaped horizontal slide assembly, a vertically movable rod is mounted on said horizontal slide assembly, a member of inverted U-shape having three perforated surfaces having the same orientation of said perforated surfaces of said crossbeam is provided at the upper end of said vertically movable rod, to reproduce said perforated surfaces of said crossbeam in a position close to the motor vehicle body, said member of inverted U-shape being arranged to receive jigs for engaging and/or checking portions of the motor vehicle body.

DESCRIPTION OF PREFERRED EMBODIMENT

Figure 1:
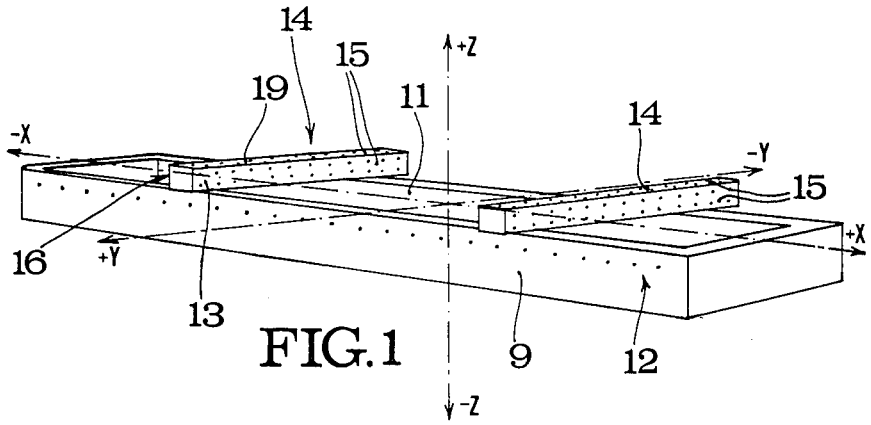
FIG. 1 is a schematic perspective view of a repair bench structure according to the present invention.

FIG. 1 schematically shows the structure of a motor vehicle body repair bench according to the invention. It substantially comprises a pair of parallel longitudinal members 9 and 11 provided with appropriate series of holes such as 12 to which crossbeams 14 are secured by means of plates, not shown. Appropriate series of threaded holes 15 are provided in the side surfaces 13 and 16 and in the upper surface 19 of the crossbeams 14. The structure is oriented according to three cartesian axes X, Y, Z.

Figure 2:
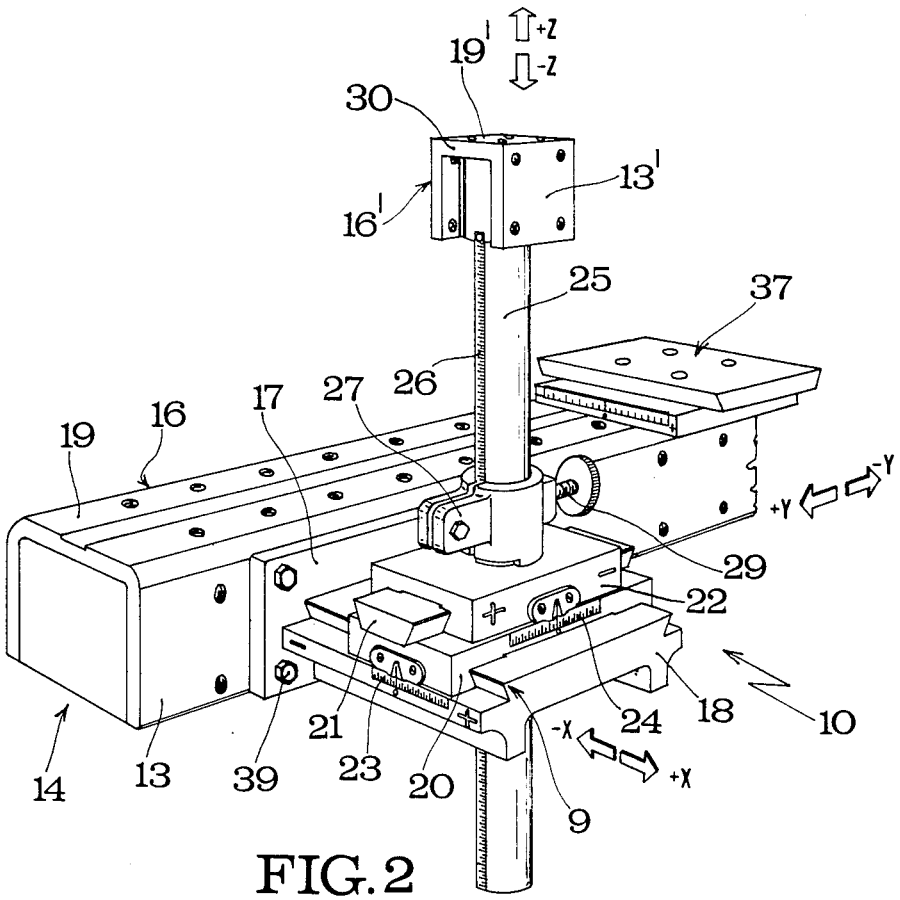
FIG. 2 is a perspective view of a standard jig support according to the present invention.

FIG. 2 shows a standard jig support 10 according to the invention mounted on a vertical surface 13 of the cross-beam 14. The standard jig support 10 comprises a bracket 18 having a vertical portion 17 secured to the surface 13 of crossbeam 14 by screw bolts 39. Bracket 18 is part of a horizontal cross-shaped slide comprising a longitudinal slide 20 movable in the direction of the axis X on dovetailed slideways 9 formed integrally with bracket 18, and a transverse slide 22 movable in the direction of the axis Y on dovetailed slideways 21 formed integrally with longitudinal slide 20. The slides 20 and 22 can be locked in the desired positions by gibs not shown.

A rod 25 movable vertically in the direction of the axis Z is mounted perpendicularly on the cross-shaped slide, i.e. the assembly comprising bracket 18, slides 20 and 22 and associated slideways. Rod 25 extends through the entire cross-shaped slide and is movable in the directions X and Y together with slides 20 and 22. For this purpose, holes not shown in the drawings are provided in bracket 18 and in the assembly comprising slide 20 and slideway 21 to permit the rod 25 to be moved as desired in said directions. Appropriate measuring scales 23, 24 and 26 permit the degree of movement in the directions X, Y and Z, respectively, to be ascertained.

Figure 3:
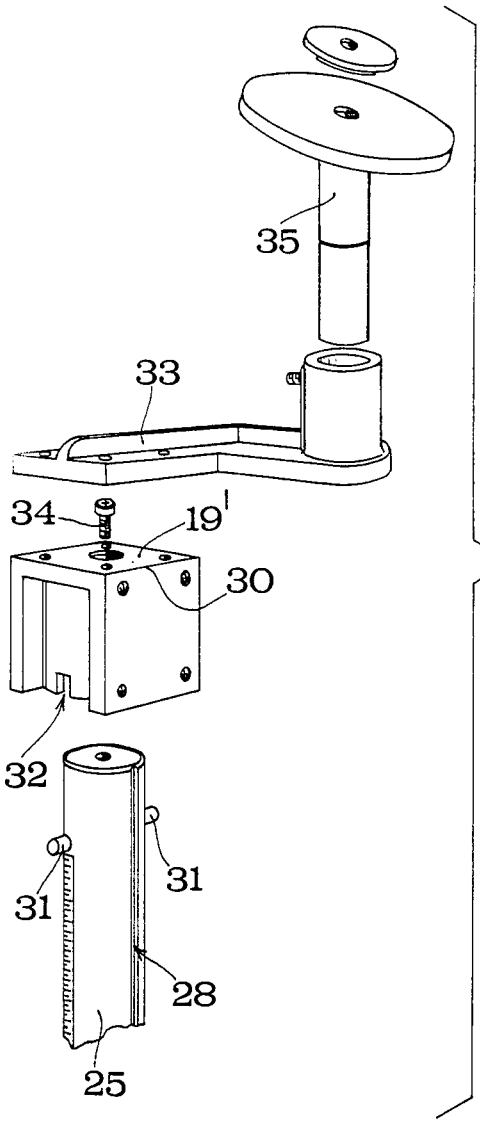
FIG. 3 is an exploded view of a portion of the standard jig support of FIG. 2 and of a jig.
Figure 4:
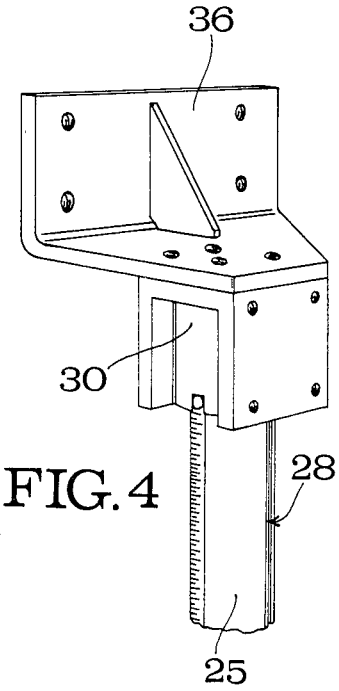
FIG. 4 is a perspective view of a portion of the standard jig support of FIG. 2 with another jig.

Locking of the rod 25 in the desired position is effected by means of a double system, known per se, comprising a collar 27 cooperating with a pressure screw 29 engaging a groove 28 shown in FIGS. 3 and 4. The rod 25 may be provided in various lengths and supports at its top a member of inverted U-shape 30 having side surfaces 13' and 16' and an upper surface 19' provided with threaded holes and extending parallel to side surfaces 13 and 16 and upper surface 19 of crossbeam 14, respectively.

FIG. 3 shows the upper end of rod 25 and the member of inverted U-shape 30 in an exploded view and illustrates the manner in which member 30 is mounted at the top of rod 25 by means of a pair of opposed pins 31 received in recesses 32 of member 30, and a screw 34 extending through member 30 into rod 25. Mounted on the upper surface 19' of member 30 is a general intermediate support member 33 supporting a jig 35 for a shock absorber.

In FIG. 4 the member 30 is shown supporting a jig 36 for engaging an engine assembly. As shown in the drawings, these jigs have been considerably simplified over conventional jigs and have reduced overall dimensions.

Figure 7:
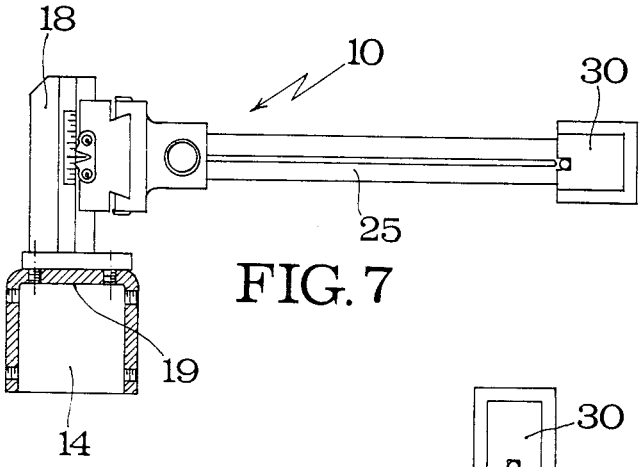
FIGS. 5, 6 and 7 are elevational views showing the standard jig support according to the invention in three different working positions.
Figure 5:
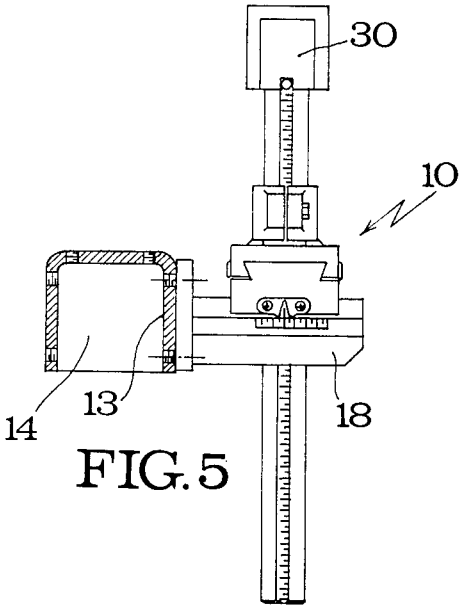
Figure 6:
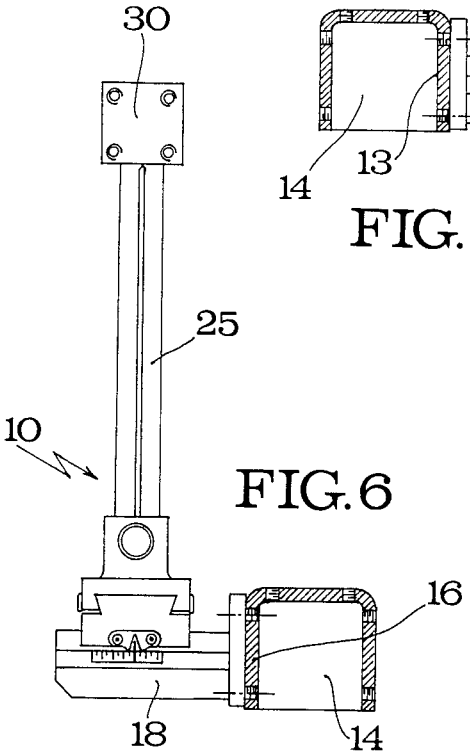

FIG. 5 is an elevational view showing the standard jig support 10 in the same position as in the perspective view of FIG. 2, i.e. mounted on side surface 13 of crossbeam 14. FIG. 6 shows the same standard jig support 10 mounted on side surface 16 of crossbeam 14 with the rod 25 in the completely extended position. FIG. 7 again shows the standard jig support 10 mounted this time on upper surface 19 of crossbeam 14 in a position as it may be used, for example, for engaging the rear bumper clamps of a motor vehicle.

The rod 25 can rotate around its own axis to permit the member 30 of inverted U-shape to be moved into various operating positions and for this purpose a plurality of vertical grooves extending parallel to groove 28 may be provided.

Returning to FIG. 2, the standard jig support may alternatively be mounted on the upper surface 19 of crossbeam 14 by means of a plate 37 instead of bracket 18. In this case two degrees of freedom of movement in the directions of the axes X and Y are obtained and a limited movement of rod 25 in the direction of the axis Z.

Figure 8:
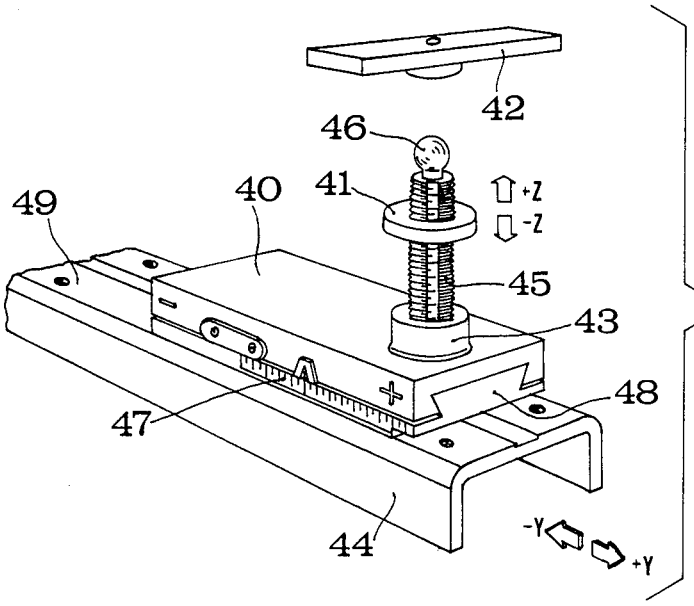
FIG. 8 is a partly exploded perspective view showing a modification of the standard jig support in an application for supporting a motor vehicle body portion below the door thereof.

FIG. 8 shows a device for supporting a motor vehicle body portion below the door thereof. Such a device can advantageously be used in the repair bench according to the invention and has a structure similar to the standard jig support 10 described above. This device for supporting the motor vehicle body portion below the door thereof is mounted on a crossbeam 44 which is perforated only in its upper surface 49. This device comprises a single slide 40 movable on a slideway 48 and provided with a graduated threaded vertical rod 45 capable of moving to a certain extent in the direction of the axis Z due to engagement in a threaded hole made in a collar 43 of slide 40. A ring nut 41 is threadably mounted on rod 45 for locking the latter in the desired position. A ball head 46 is provided at the top of rod 45 to provide a ball joint for a plate 42 for supporting the motor vehicle body portion below the door thereof. The extent of translation of slide 40 can be adjusted with the aid of a scale 47.

The repair bench with the standard jig support 10 as described above affords considerable advantages. Above all it is to be considered that in a conventional motor vehicle body repair system using jigs the latter are formed by a single member interposed between the repair bench and the motor vehicle body portion to be repaired and/or checked. It follows that, as mentioned in the introductory part to the specification, a jig having a particular spatial configuration is required for each of those body portions. On the contrary; the standard jig support according to the present invention is universally applicable and can assume a multiplicity of spatial configurations within the structure of the support itself by means of the movement of two horizontal slides and a vertical rod. Further, the member 30 of inverted U-shape ideally reproduces a portion of the crossbeam by transferring it to a position close to the motor vehicle body which can thus be gripped and/or checked, also by means of a system using "jigs", but in this case the "jig" is a simplified member of minimum overall dimensions, which is also characterized by a considerable degree of universality, i.e. versatility of use.

Thus, while the feature of fixing the vehicle body by means of the well known system using jigs, which has been tried in body-shops and is service-proved, is maintained, the advantages of the "metric" systems are acquired, since it is possible to make an estimate of the deformations of the damaged vehicle body by consulting the scales on the axes X, Y and Z, without assuming the disadvantages of these "metric" systems. In fact, the standard jig support 10 has three degrees of freedom of movement defined within its own structure so that it is always possible to check and/or fix portions of the vehicle body, which are asymmetric relative to a crossbeam, by means of a pair of such supports mounted on the same crossbeam by selecting appropriate values of the coordinates X, Y, Z or varying the position of fixing of the standard jig support on the crossbeam. Further, with the repair bench provided with the standard jig supports according to the invention it is possible to mount on the three surfaces provided with threaded holes of the same crossbeam a plurality of supports in the various possible operating positions to fix and/or check simultaneously a plurality of vehicle body portions. Thus, the method of "positive" repair is maintained as various body portions can be fixed simultaneously with or without disassembling the motor vehicle and such body portions can be located anywhere on the body.

Although a preferred embodiment of the invention has thus been described in detail and illustrated in the accompanying drawings, it is to be understood that the invention is not limited to this precise embodiment and that numerous changes and modifications obvious to one skilled in the art may be made therein without departing from the scope of the invention as defined by the appended claims.

I claim:

1. A motor vehicle body repair bench having standard jig supports and a structure comprising a pair of parallel longitudinal members to which crossbeams with perforated side and upper surfaces are secured, characterized in that each of said standard jig supports is removably mounted on said crossbeams and comprises:

a cross-shaped horizontal slide assembly supported by a bracket arranged to be secured to a surface of said crossbeam, said cross-shaped horizontal slide assembly comprising a longitudinal slide and a transverse slide;

a rod mounted perpendicularly on said horizontal slide assembly, and movable through a hole in said cross shaped horizontal slide assembly, said rod being also movable in unison with said longitudinal slide and said transverse slide in the longitudinal and transverse directions, respectively; and a member of inverted U-shape having three perforated surfaces having the same orientation of said perforated surfaces of said crossbeam, provided at the upper end of said movable rod, to reproduce said perforated surfaces of said crossbeam in a position close to a damaged motor vehicle body to be repaired or checked; said member of inverted U-shape being arranged to receive jigs for engaging and/or checking portions of the damaged vehicle body.

2. A motor vehicle body repair bench having standard jig supports as claimed in claim 1, wherein each of said longitudinal and transverse slides and said movable rod is provided with a measuring scale for indication of the extent of their movement.

3. A motor vehicle body repair bench having standard jig supports as claimed in claim 1, wherein said cross-shaped horizontal slide assembly is secured directly to one surface of said crossbeam by means of a plate interposed therebetween.

* * * * *